United States Patent [19]

Asano et al.

[11] 4,132,200

[45] Jan. 2, 1979

[54] EMISSION CONTROL APPARATUS WITH REDUCED HANGOVER TIME TO SWITCH FROM OPEN- TO CLOSED-LOOP CONTROL MODES

[75] Inventors: Masaharu Asano, Yokosuka; Shigeo Aono, Tokyo; Akio Hosaka, Yokohama; Kōkichi Ochiai, Fujisawa; Michiyoshi Yamane, Tokyo, all of Japan

[73] Assignee: Nissan Motor Company, Limited, Yokohama, Japan

[21] Appl. No.: 767,989

[22] Filed: Feb. 11, 1977

[30] Foreign Application Priority Data

Feb. 12, 1976 [JP] Japan ..... 51-13252

[51] Int. Cl.[2] ..... F02B 32/00; F02B 75/10

[52] U.S. Cl. ..... 123/119 EC; 123/32 EE; 60/276; 60/285

[58] Field of Search ..... 123/32 EE, 32 EA, 32 EH, 123/32 EB, 119 EC, 119 E; 60/276, 285

[56] References Cited

U.S. PATENT DOCUMENTS

| | | | |
|---|---|---|---|
| 3,921,612 | 11/1975 | Aono | 123/119 EC |
| 3,938,479 | 2/1976 | Oberstadt | 123/32 EE |
| 3,939,654 | 2/1976 | Creps | 123/119 EC |
| 3,986,352 | 10/1976 | Casey | 60/285 |
| 4,019,474 | 4/1977 | Nishimiya et al. | 123/32 EE |
| 4,029,061 | 6/1977 | Asano | 60/285 |
| 4,030,462 | 6/1977 | Sasayama et al. | 60/285 |
| 4,048,479 | 9/1977 | Rivere | 123/32 EA |
| 4,057,042 | 11/1977 | Aono | 60/276 |
| 4,058,978 | 11/1977 | Bockelmann et al. | 123/119 EC |

*Primary Examiner*—Charles J. Myhre
*Assistant Examiner*—R. A. Nelli
*Attorney, Agent, or Firm*—Bacon & Thomas

[57] ABSTRACT

A closed-loop emission control apparatus for internal combustion engines includes exhaust composition sensor for feedback control of the air-fuel mixture. When the temperature in the exhaust passage is lower than the operating temperature of the sensor, control is switched to an open-loop mode. The feedback control signal is fluctuated above and below a predetermined DC bias at periodic intervals during the open-loop mode to switch the control to the closed-loop mode in a minimum transition time as soon as the sensor's temperature condition warrants feedback control.

10 Claims, 5 Drawing Figures

TO AIR-FUEL PROPORTIONING DEVICE 10
FROM OUTPUT OF COMP 26
FROM OUTPUT OF AMPL 17
PULSE GENERATER
+Vcc
R4
R5
R6
R7
R8
R9
R10
R11
R12
C2
C3
C4
S1
S2
U1
D2
D3
20
21
22
23
24
26
27
30
U
S

EMISSION CONTROL APPARATUS WITH REDUCED HANGOVER TIME TO SWITCH FROM OPEN- TO CLOSED-LOOP CONTROL MODES

FIELD OF THE INVENTION

The present invention relates generally to closed-loop emission control apparatus for internal combustion engines, and in particular to such apparatus which minimizes the hangover time of open-loop mode when the temperature condition for exhaust composition sensor warrants the start of feedback control operation.

BACKGROUND OF THE INVENTION

In the prior art closed-loop emission control apparatus, the concentration of an exhaust composition such as residual oxygen is sensed and fed back to an air-fuel mixing and proportioning device to control the air-fuel ratio of the mixture delivered to the engine. The noxious components (CO, HC and NOx) are simultaneously converted into harmless products at the maximum efficiency if the air-fuel ratio is controlled at a value in the vicinity of stoichiometry. The exhaust composition sensor such as oxygen sensor is usually operable at elevated temperatures higher than 400° C., and during engine warm-up periods the output from the composition sensor remains at a low voltage level. Under these circumstances, it is desirable to inhibit the feedback operation and allow the engine to operate in open-loop mode using the normal carburetion or fuel injection. Since the operating characteristic of the oxygen sensor is such that its output has a steep transition in amplitude at stoichiometry from the high voltage state for richer mixtures to the low voltage state for leaner mixtures, when the sensor's operating temperature has been reached and if leaner mixtures are supplied under the open-loop mode, then the sensor output still continues its low voltage condition and will cause the system to hangover in the open-loop mode even though the temperature condition warrants feedback control. Therefore, it is necessary to supply a quantity of rich mixtures prior to the start of closed-loop feedback control in order to reduce the hangover time. Actually, the components that make up a control loop are manufactured with a different degree of accuracy, so that the total value of accuracy of the loop of electronic fuel injection, for example, may amount to ±10%. With electronic fuel injection in which the width of the injection pulse is controlled by a signal containing proportional, integral and DC bias components, a 10% increase of the DC bias under open-loop mode would amount to a 20% increase in fuel supply in an extreme case. This is unfavorable from the emission control standpoint.

SUMMARY OF THE INVENTION

An object of the present invention is therefore to provide an improved closed-loop emission control apparatus which relaxes the manufacturing tolerance of the components that constitute the feedback control loop.

Another object of the invention is to provide an improved closed-loop emission control apparatus which reduces the hangover time of the open-loop operation to a minimum by fluctuating a control signal above and below a predetermined DC bias at periodic intervals during the open-loop mode to alternate the supply of rich and lean mixtures to the engine.

A further object of the invention is to reduce the amount of noxious components during the open-loop mode when the temperature condition for the exhaust composition sensor can hardly assure normal feedback control operation.

BRIEF DESCRIPTION OF THE DRAWINGS

These and other objects, features and advantages of the present invention will be understood from the following description taken in conjunction with the accompanying drawings, in which.

DESCRIPTION OF THE PREFERRED EMBODIMENTS

Figure 1:
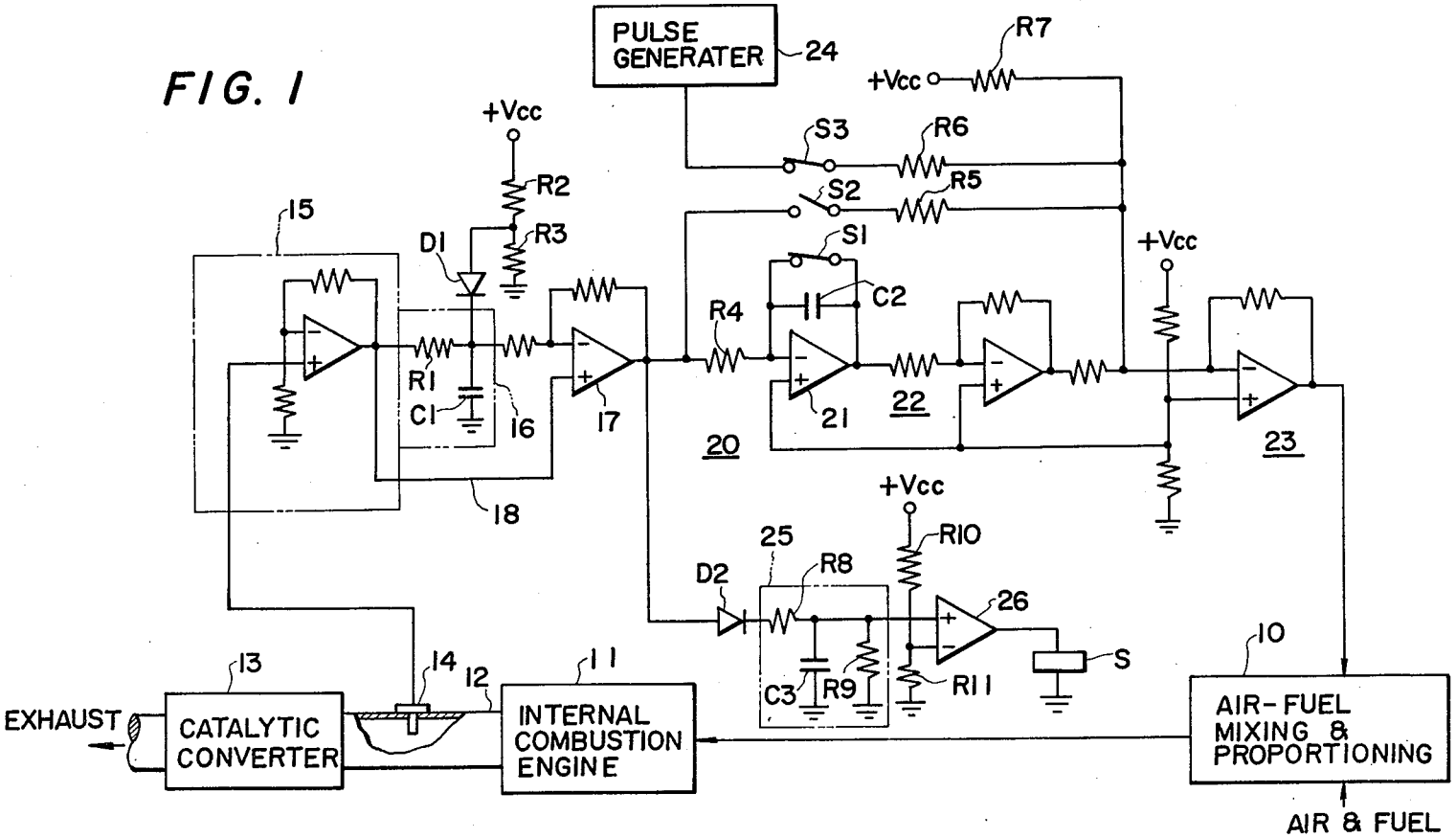
FIG. 1 is a circuit diagram of a first embodiment of the invention.

In FIG. 1 emission control apparatus embodying the invention is shown in which an air-fuel mixing and proportioning device 10 delivers a mixture of air and fuel to the internal combustion engine 11 which in turn delivers exhaust emissions through exhaust pipe 12 to a catalytic converter 13. In the exhaust pipe 12 is disposed an exhaust composition sensor such as oxygen sensor 14 which senses the concentration of the residual oxygen in the emissions to provide an output representative of the sensed concentration to a DC buffer amplifier 15.

The air-fuel mixing and proportioning device 10 includes a carburetor of conventional design with a venturi (not shown) and electromagnetic valves responsive to an input signal applied thereto to deliver air-fuel mixture in response to the applied signal in addition to the quantity of mixture delivered through the venturi action of the carburetor. Therefore, the air-fuel mixing and proportioning device permits manual override facility even though the input signal remains at a constant level when the proportional and integral controllers are disabled.

The buffer amplifier 15 provides isolation of the subsequent stage of the circuitry from the exhaust composition sensor 14. The output from the amplifier 15 is applied on the one hand through an averaging circuit 16 formed by an RC filter circuit to the inverting input of a differential amplifier 17, and on the other hand through lead 18 to the noninverting input of the amplifier 17.

The RC filter averaging circuit 16 includes a resistor R1 and a capacitor C1 coupled to ground and the junction therebetween is coupled to the inverting input of the differential amplifier 17 and to the cathode terminal of a diode D1 whose anode is coupled to a point intermediate resistors R2 and R3 which constitute a voltage divider. Capacitor C1 is changed through diode D1 when the voltage thereacross becomes lower than the voltage set by the voltage divider.

The output from the RC filter circuit 16 is an average or mean value of the sensed oxygen concentration. The output from the differential amplifier 17 thus indicates the deviation of the instantaneous value of sensed concentration from its mean value.

An integral controller 20 formed by an operational amplifier 21 and an integrating capacitor C2 coupled across the inverting input and the output of the amplifier and an integrating resistor R4 through which the output from the differential amplifier 17 is applied to the inverting input thereof. In shunt with the capacitor C2 is connected a normally closed relay contact unit S1 which, when closed, discharges the capacitor C2 when the feedback control is disabled to be described later.

The output of the integral controller 20 is connected to an inverter 22 to secure phase correspondence with the output from a proportional controller formed by a resistor R5. The proportional controller R5 is connected through a normally open relay contact unit S2 between the output of differential amplifier 17 and the input to a summation amplifier 23 to which the inverted output of integral controller is also applied.

To the summation point of the amplifier 23 is also connected a Dither pulse generator 24 through a normally closed relay contact unit S3 and a resistor R6. The pulse generator 24 provides a train of bipolar pulses having symmetrical waveforms of opposite polarities so that the mean value of its amplitude is zero. Thus, the bipolar pulses may take the form of sinusoidal, rectangular or triangular signal. Also connected to the summation point is DC voltage supply Vcc through a resistor R7 to provide a bias potential thereto.

The output from the differential amplifier 17 is also connected through a diode D2 to an RC filter circuit 25 whose output is connected to the noninverting input of an operational amplifier comparator 26 for comparison with a reference voltage supplied from a voltage divider formed by resistors R10 and R11. The filter circuit 25 includes a resistor R8 connected between the cathode of diode D2 and the noninverting input of the comparator, a capacitor C3 coupled between the resistor R8 and ground, and a resistor R9 having a greater resistance value than resistor R8 and connected in parallel with the capacitor C3. The resistor R8 is to prevent noise from influencing the potential at the noninverting input of the comparator and the resistor R9 is shunt with capacitor C3 filter out the high-frequency components of the output of differential amplifier 17.

The comparator 26 normally delivers an output which energizes a relay S so that its contacts S1 and S3 are normally open and S2 closed. When the filtered output falls below the reference level relay S will be deenergized.

The air-fuel mixing and proportioning device 10 receives its input signal from the summation amplifier 23 to control the air-fuel ratio in response to the signal combined at the summation point.

Figure 4:
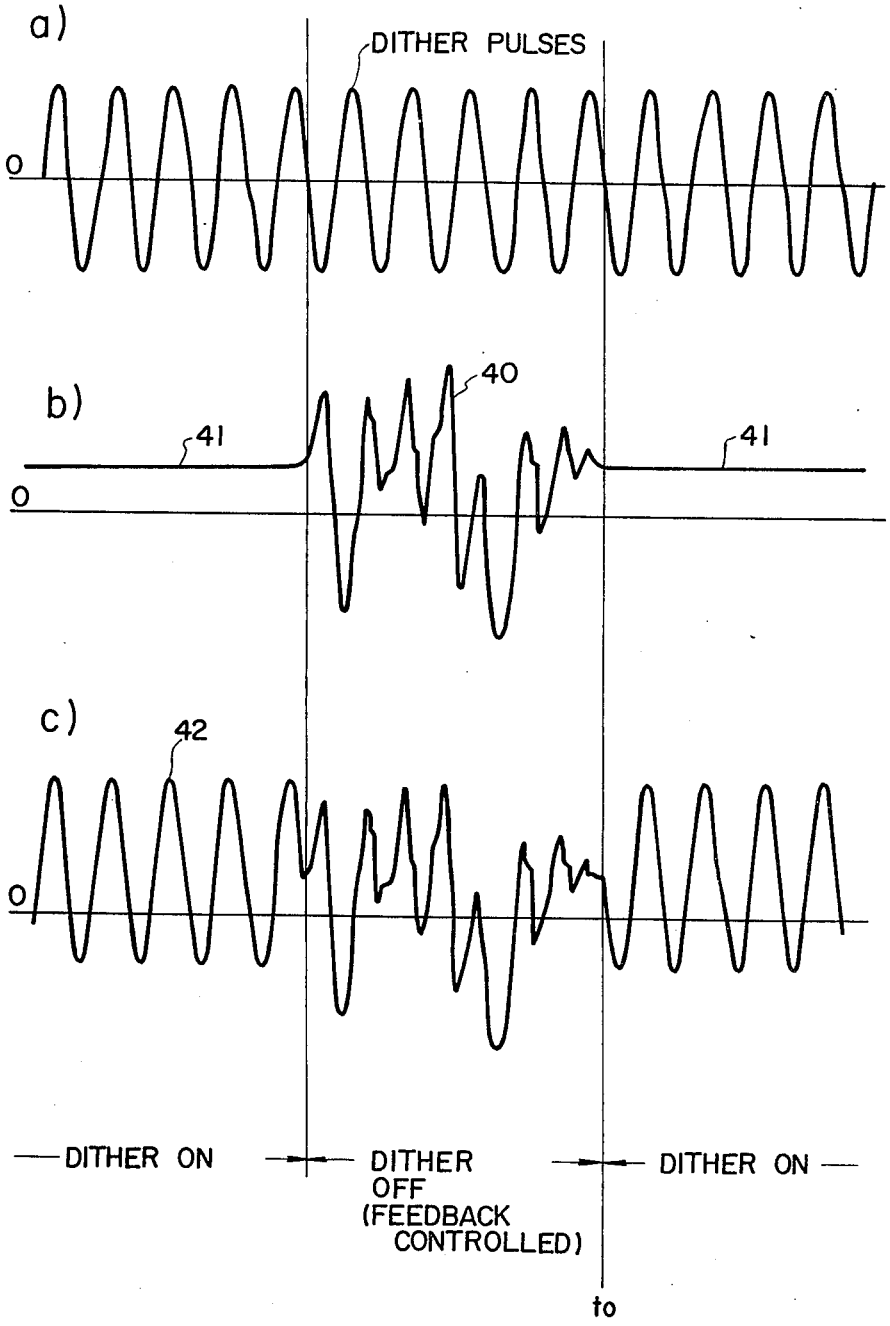
FIG. 4 is a waveform diagram useful for describing the operation of FIG. 1.

In operation, under normal operating temperature conditions the oxygen sensor 14 delivers an output which fluctuates in amplitude as indicated by numeral 40 in FIG. 4*b* because of the control oscillation resulting from the inherent delay time existing in the engine 11 from the time of ignition to the time of detection at the sensor 14. The signal delivered from the oxygen sensor 14 is compared with its mean value and integrated by the integrator 20 at a rate determined by the time constant R4, C2 so that the output of amplifier 21 increases linearly. The direction of increase is reversed by the inverter 22 and added up to the proportional output through resistor R5.

When the oxygen sensor 14 delivers a low voltage output during the engine start-up period when the internal impedance of the sensor is extremely high, the comparator 26 is switched to the output-low voltage state to deenergize relay S. In response thereto relay contacts are released to provide a short circuit across capacitor C2 by contact unit S1 and the proportional controller is disconnected by contact S2. The closure of contact S3 couples the bipolar pulses as indicated by the waveform shown in FIG. 4*a* from generator 24 to the summation point.

Therefore, the signal at the summation point is a DC bias as indicated by numeral 41 (FIG. 4*b*) plus the bipolar sinusoidal pulses, thus resulting in a waveform shown at 42 in FIG. 4*c*. Under this condition both proportional and integral controllers are disabled and the air-fuel mixture is controlled by the pulsating voltage whose average value corresponds to the DC bias potential provided from the Vcc supply source through resistor R7. This DC bias is selected at a value which assures that air-fuel ratio becomes richer than stoichiometry during the start-up period when the controllers are disabled.

By forced fluctuation of the control voltage above and below the DC control bias level 41, mixture is alternately enriched and leaned and a repeated induction of such rich mixtures will result in a rapid increase in the average value of the sensed oxygen concentration above the detector's level which triggers the system to start feedback operation. This eliminates the need for precisely controlling the DC bias potential for each emission control apparatus.

As soon as the oxygen sensor starts delivery of a normal fluctuating control signal, the comparator 26 will be switched to the output-high state and energizes the relay S to operate its relay contacts S1 to S3.

In the embodiment of FIG. 1, the Dither pulses are switched on and off at the instant the comparator 26 senses the respective conditions. It is preferable to provide a delayed switching for the Dither pulses in response to the sensed conditions. This is advantageous in that when the temperature within the exhaust passage has reached the point whereupon the controllers are brought into action, the turn-off of Dither pulse immediately upon the sensing of the condition justifying the feedback control will likely to result in a lean mixture depending upon the voltage of the Dither pulse at the instant of turn-off. This will cause Dither pulses to be switched on and off repeatedly. Therefore, it is preferable to allow the Dither pulses to continue for a certain length of time after the normal condition has been sensed.

It is sometimes the case that when the engine rpm has been decreased upon deceleration and the exhaust temperature has consequently reduced to such a degree that the oxygen sensor output falls to the low voltage level. Under such circumstances, it is desirable that the controllers be disabled as promptly as possible. In order to assure that the control loop be disabled as promptly as possible, it is preferable to allow for a certain period of time prior to the application of Dither pulses.

Figures 2, 3:
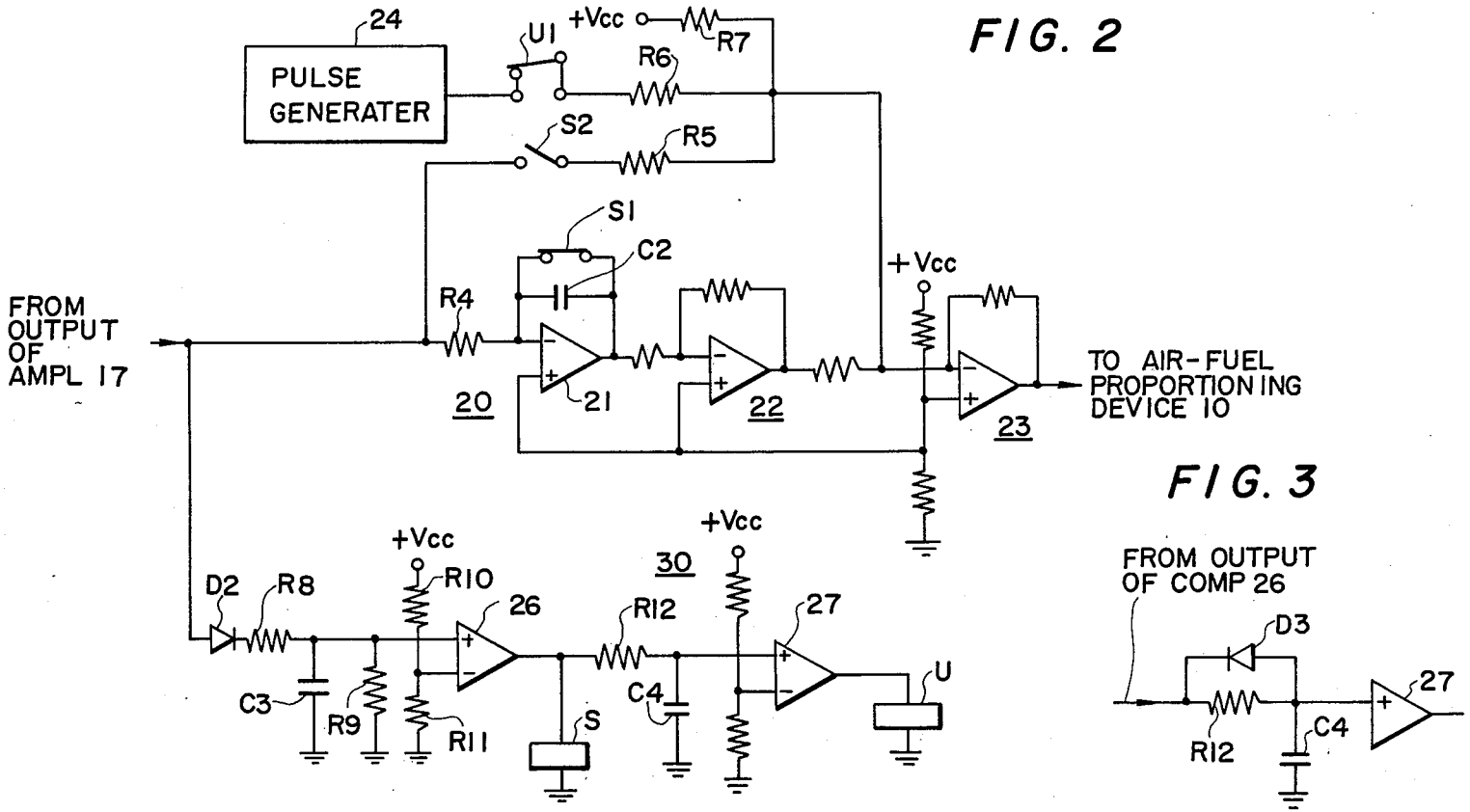
FIG. 2 is a circuit diagram of a second embodiment of the invention.
FIG. 3 is a modification of the second embodiment.
Figure 5:
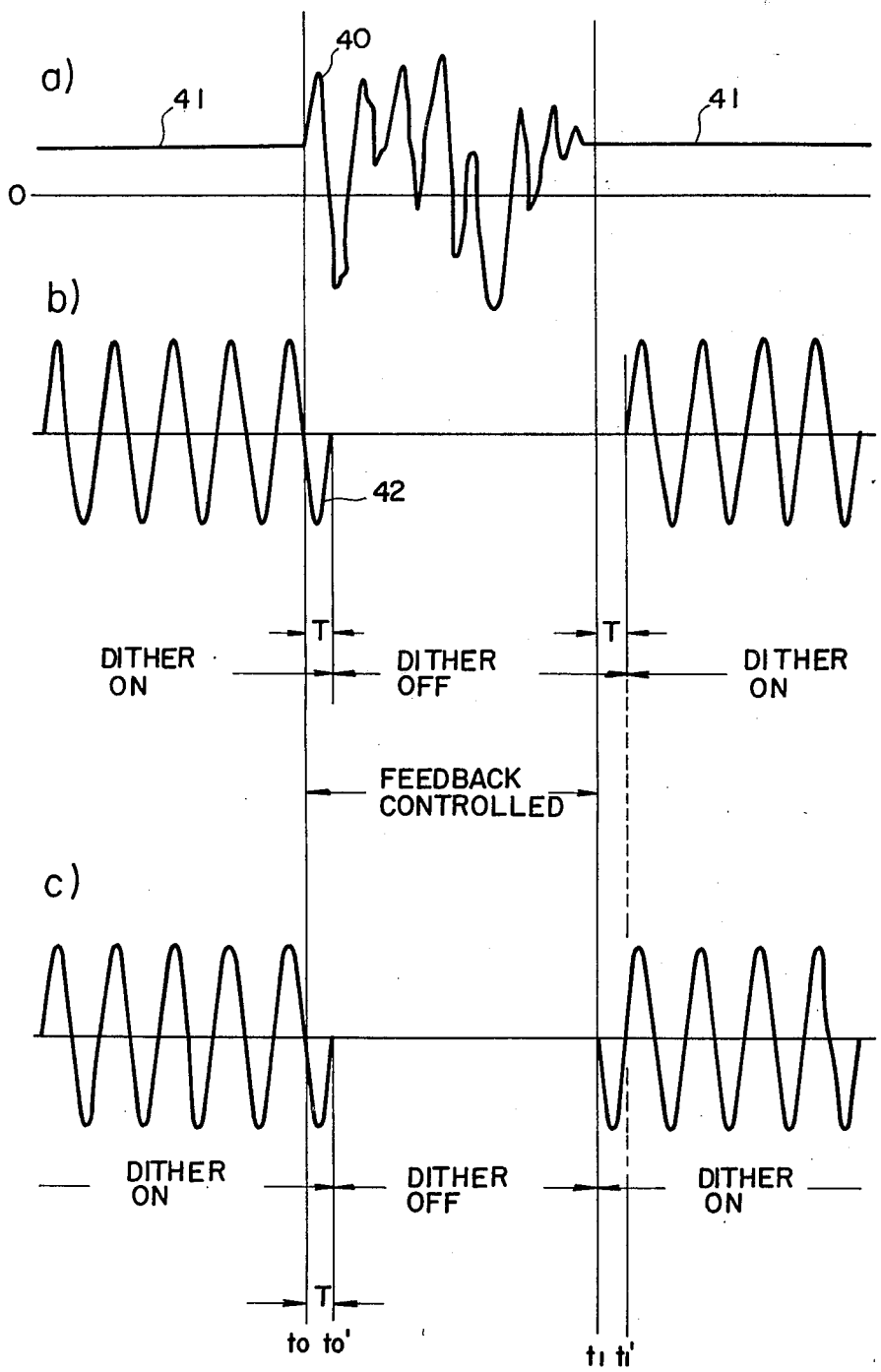
FIG. 5 is a waveform diagram useful for describing the operation of FIGS. 2 and 3.

The embodiment of FIG. 2 incorporates such features as described above, wherein similar parts are numbered with identical numbers. The circuit of FIG. 2 differs from the embodiment of FIG. 1 in that a delayed switching circuit 30 is provided connected to the output of comparator 26 and the relay contact unit S3 is replaced by a similar contact unit U1 operated by a relay U. The delayed switching circuit 30 comprises a resistor R12 connected between the output of comparator 26 and the noninverting input of a comparator 27 and a capacitor C4 coupled to ground to constitute an input to the comparator 27. The time constant of the resistor R12 and capacitor C4 is such that the voltage across the capacitor C4 reaches the threshold level of the comparator 27 (determined by the potential at the inverting input) a predetermined time interval T after the sensing of the high-voltage condition of the oxygen sensor at time $t_o$ and after the sensing of the low-voltage condition at time $t_1$ as shown in FIGS. 5*a* and 5*b*.

At time $t_o$ when the high-voltage condition of the sensor 14 is detected, the relay S is energized to open the contact S1 while closing the contact S2 in the proportional controller. Both controllers are thus brought into enabled condition. After the interval T, comparator 27 is switched on to energize relay U to disconnect Dither pulses from the summation point by opening its contact unit U1. During the time interval from $t_0$ to $t_0'$ there is an overlap of the control signal 40 and a Dither pulse 42.

At time $t_1$ when the low-voltage condition is sensed, the relay S is de-energized to close its contact S1 and after time interval T the relay U is de-energized to close its contact unit U1 so that during time interval from $t_1$ to $t_1'$, the control voltage is set at the DC bias level 41.

In a modification of FIG. 2 seen in FIG. 3 the resistor R12 is in shunt with a diode D3 which is arranged such that its direction of conductivity is exposed to a negative signal from the comparator 26. The capacitor C4 will be charged at a lower rate through resistor R12 when the high voltage condition is sensed than it is dicharged through diode D3 when the low-voltage condition is sensed. A delayed switching action is thus provided for the Dither pulse at time $t_0$, while quick response action is provided at time $t_1$ as shown in FIG. 5*c*. This quick response characteristic is desirable for a particular engine performance.

What is claimed is:

1. Closed-loop emission control apparatus for an internal combustion engine having an air-fuel mixing and proportioning device for delivery of air-fuel mixture to said engine in response to a control signal applied thereto, comprising:

an exhaust composition sensor for sensing the concentration of an exhaust composition of the emissions from the engine to provide a concentration representative signal;

means for generating a signal representative of the difference between the concentration representative signal and a reference value;

means for modulating the amplitude of the difference representative signal in accordance with a predetermined control characteristic to provide said control signal;

means for detecting when the sensed concentration remains at a value lower than a predetermined value for a duration exceeding a predetermined duration to generate an output;

means for disabling said modulating means in response to the output of said detecting means; and means responsive to the output of said detecting means for fluctuating the control signal above and below a predetermined level at periodic intervals.

2. Closed-loop emission control apparatus as claimed in claim 1, wherein said means for generating the difference representative signal comprises a differential amplifier having a first input connected to receive said concentration representative signal and a second input, and wherein said reference signal is generated by a filter having a resistor and a capacitor connected in series to receive said concentration representative signal, the junction between said resistor and capacitor being connected to the second input of said differential amplifier for comparison with said concentration representative signal.

3. Closed-loop emission control apparatus as claimed in claim 2, further comprising a diode coupled between the junction of said resistor and capacitor and a DC voltage source and arranged such that the direction of its conductivity allows a current to flow from said voltage source to said capacitor when the voltage across the capacitor is below the voltage of said source.

4. Closed-loop emission control apparatus as claimed in claim 1, wherein said fluctuating means comprises means for generating a periodically alternating waveform signal symmetrical with respect to a zero voltage level, means for connecting said alternating waveform signal to said air-fuel mixing and proportioning device, and means for delaying the connection of said alternating waveform signal for a predetermined period in response to the output from said detecting means.

5. Closed-loop emission control apparatus as claimed in claim 4, wherein said detecting means comprises means for detecting when the sensed concentration remains at a value higher than said predetermined value to generate a second output, further comprising means for prolonging the connection of said alternating waveform signal for a predetermined period in response to the second output of said detecting means.

6. Closed-loop emission control apparatus as claimed in claim 4, wherein said fluctuating means further comprises:

a DC bias source; and a summation amplifier receptive of said control signal from said modulating means, said alternating waveform signal and a DC potential from said DC bias source.

7. Closed-loop emission control apparatus as claimed in claim 6, further comprising a resistor and a capacitor connected in series to the output of said detecting means, a diode connected across said resistor, means for comparing the voltage across said capacitor with a reference value, switching means for connecting said alternating a waveform signal to said summation amplifier in response to the output from said comparing means.

8. Closed-loop emission control apparatus as claimed in claim 6, wherein said detecting means comprises means for detecting when the sensed concentration remains at a value higher than said predetermined value to generate a second output, further comprising a resistor and a capacitor connected in serires to the output of said detecting means so that said capacitor is charged through said resistor in response to the second output of said detecting means, means for comparing the voltage across said capacitor with a reference value, and switching means for connecting the alternating waveform signal to said summation amplifier in response to the output from said comparing means.

9. Closed-loop emission control apparatus as claimed in claim 6, wherein said modulating means comprises an integrator having an operational amplifier, a resistor and a capacitor connected in series to the output of said difference signal generating means, and wherein said disabling means comprises switching means responsive to the first output from said detecting means for providing a short circuit path across said capacitor.

10. Closed-loop emission control apparatus as claimed in claim 6, wherein said modulating means comprises means connected to the output of said difference signal generating means for proportionally varying the amplitude of said difference representative signal, and wherein said disabling means comprises switching means responsive to the first output from said detecting means for disconnecting said amplitude varying means from said difference signal generating means.

* * * * *